US007557787B2

(12) United States Patent
Kim

(10) Patent No.: US 7,557,787 B2
(45) Date of Patent: Jul. 7, 2009

(54) DRIVING METHOD OF FS-LCD

(75) Inventor: Tae-Soo Kim, Busan (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 795 days.

(21) Appl. No.: 10/973,262

(22) Filed: Oct. 27, 2004

(65) Prior Publication Data

US 2005/0116912 A1 Jun. 2, 2005

(30) Foreign Application Priority Data

Nov. 29, 2003 (KR) ..... 10-2003-0086148

(51) Int. Cl.
*G09G 3/36* (2006.01)
*G09G 5/10* (2006.01)

(52) U.S. Cl. ..... 345/89; 345/690

(58) Field of Classification Search ..... 345/55–100, 345/204–214, 690–697
See application file for complete search history.

(56) References Cited

U.S. PATENT DOCUMENTS 5,444,457 A * 8/1995 Hotto ..... 345/94
5,619,224 A * 4/1997 Hoshino et al. ..... 345/98
5,844,537 A * 12/1998 Bonnett et al. ..... 345/97
5,953,002 A * 9/1999 Hirai et al. ..... 345/690
6,215,466 B1 4/2001 Yamazaki et al.
6,472,946 B2 10/2002 Takagi
6,567,063 B1 5/2003 Okita
7,138,972 B2 * 11/2006 Ito et al. ..... 345/89
2002/0017962 A1 2/2002 Takagi
2006/0227078 A1 * 10/2006 Shino et al. ..... 345/75.2

FOREIGN PATENT DOCUMENTS

CN 1072271 5/1993

(Continued)

OTHER PUBLICATIONS

Office Action issued in Korean Patent Application No. 2003-86148 on Nov. 23, 2005.

(Continued)

*Primary Examiner*—David L Lewis
(74) *Attorney, Agent, or Firm*—Stein McEwen, LLP

(57) ABSTRACT

A method of driving a liquid crystal display, having a liquid crystal interposed between an upper substrate and a lower substrate, capable of implementing a full color display with a low driving frequency and without increasing the number of bits of driving data by using an analog and digital mixed driving technique the method includes driving the liquid crystal in accordance with driving data of predetermined bits corresponding to each gradation, wherein a pulse corresponding to each bit of the driving data has a predetermined pulse width and a predetermined voltage level, and at least one of the pulse widths and the voltage levels of a pulse corresponding to each bit of the driving data is varied to drive the liquid crystal so that the gradation is displayed. The pulse corresponding to at least one bit of the driving data of predetermined bits is made to have at least one of its width and voltage level varied in accordance with the gradation, or is made to have its voltage level constant and its width varied, to have its pulse width constant and its voltage level varied, or is made to have its pulse width and voltage level varied at the same time.

21 Claims, 10 Drawing Sheets

FOREIGN PATENT DOCUMENTS

| | | |
|---|---|---|
| JP | 8-95531 | 4/1996 |
| JP | 2001-350439 | 12/2001 |
| JP | 2002-350749 | 12/2002 |
| JP | 2003-98505 | 4/2003 |
| JP | 2003-99015 | 4/2003 |
| JP | 2003-107425 | 4/2003 |
| JP | 2003-316324 | 11/2003 |
| KR | 1996-3961 | 3/1996 |
| KR | 2001-110349 | 12/2001 |

OTHER PUBLICATIONS

English abstract for Korean Patent Publication No. 1993- 8706.

Office Action issued on Feb. 9, 2007 by the Chinese Intellectual Property Office for Chinese Patent Application No. 200410097425.5.

Okada, H. et al., "An 8-bit Digital Data Driver for AMLCDs", Jun. 14, 1994, SID International Symposium Digest of Technical Papers, vol. 25, pp. 347-350.

* cited by examiner

DRIVING METHOD OF FS-LCD

CROSS-REFERENCE TO RELATED APPLICATION

This application claims the benefit of Korea Patent Application No. 2003-86148 filed on Nov. 29, 2003, in the Korean Intellectual Property Office, the disclosure of which is incorporated herein by reference.

BACKGROUND OF THE INVENTION

1. Field of the Invention

The present invention relates to a field sequential driving type liquid crystal display (FS-LCD) and, more particularly, to a method for driving a liquid crystal display with a digital driving type and an analog driving type mixed.

2. Description of the Related Art

In general, a color liquid crystal display includes an upper substrate, a lower substrate, a liquid crystal panel having the liquid crystal injected between the upper and lower substrates, a driving circuit for driving the liquid crystal panel, and a backlight for providing a white light to the liquid crystal. This liquid crystal display is classified into two types: a R, G and B color filter mode and a color field sequential driving mode based on the mode that color images are displayed.

The color filter type liquid crystal display divides one pixel into R, G and B subpixels. R, G and B color filters are arranged at the R, G and B subpixels, respectively. Light is delivered to the R, G and B color filters through the liquid crystal from one backlight to display the color images.

In contrast, the color field sequential driving type liquid crystal display has R, G and B backlights arranged at one pixel that is not divided into the R, G and B subpixels. Light of three primary colors from the R, G and B backlights is sequentially displayed at the pixel through the liquid crystal in a time-division manner, so that the color images are displayed by means of an after-image effect of the eyes.

The color field sequential driving type liquid crystal display sets a plurality of reference voltages corresponding to the number of gradations to be displayed, selects one reference voltage corresponding to the gradation display data among the plurality of reference voltages using an analog switch, drives the liquid crystal panel with the selected reference voltage, and performs the gradation display with an amount of transmission light corresponding to the applied voltage.

FIGS. 1A and 1B show waveforms explaining a method of driving the liquid crystal display performing a gradation display by varying the driving voltage of the liquid crystal in accordance with the prior art. In particular, FIGS. 1A and 1B show the waveforms with respect to the driving voltages applied to the liquid crystal and the amount of light transmitted to the liquid crystal based on the driving voltages.

Referring to FIGS. 1A and 1B, a driving voltage of V11 level is applied to the liquid crystal during a period T1 that ranges from the time t1 to the time t3, and light corresponding to the driving voltage of V11 level is transmitted to the liquid crystal. A driving voltage of V12 level higher than the V11 level is applied during a period T2 that ranges from t4 to t6, and an amount of transmission light corresponding to the driving voltage of V12 level is obtained. A driving voltage of V13 level higher than the V12 level is applied during a period T3 that ranges from t7 to t9, and an amount of transmission light corresponding to the driving voltage of V13 level is obtained.

The Red color is displayed during the period Tr that ranges from t2 to t3, which causes a Red light emitting diode of the R backlight to emit light, the Green color is displayed during the period Tg that ranges from t4 to t6, which causes a Green light emitting diode of the G backlight to emit light, and the Blue color is displayed during the period Tb that ranges from t8 to t9, which causes a Blue light emitting diode of the B backlight to emit light.

In the analog type driving method varying the above-mentioned driving voltages, there exist problems of tailing, blurring of colors, low contrast ratio, and stroboscopic motions. Furthermore, the analog type driving method displays the gradation with the degree of the driving voltage applied to the liquid crystal, which causes difficulty in implementing a fine gradation display.

To cope with the above-mentioned problems, Japanese Patent Publication Nos. 2003-98505, 2003-099015, and 2003-107425 disclose methods for displaying the gradation by means of digital control.

One method for displaying the gradation by means of digital control has a voltage applying time corresponding to the gradation to be written into a look-up table, reads out the voltage applying time corresponding to the gradation data from the look-up table, and applies a predetermined voltage to the liquid crystal during the voltage applying time corresponding to the gradation data to thereby perform the gradation display. This method makes the driving voltage applied to the liquid crystal constant, and controls the voltage applying time to perform the gradation display. As such, the driving voltage is kept constant and the voltage applying state and the voltage non-applying state are controlled with respect to their timings, so that a response time of the liquid crystal based on the gradation level can improve.

Another method for displaying gradation by means of digital control has an applying pattern corresponding to the gradation written into a look-up table, reads out the applying pattern corresponding to the gradation data from the look-up table, and applies a predetermined level of driving voltage to the liquid crystal based on the read applying pattern within a light emitting unit period of a light emitting diode to thereby perform the gradation display. This method makes the applying pattern be varied within the light emitting unit period of the light emitting diode and the voltage applying state and the voltage non-applying state controlled with respect to their timings. As such, the gradation display is performed based on the voltage applying time, so that a response time of the liquid crystal can improve.

Yet another method for displaying the gradation by means of digital control has an area corresponding to each gradation, wherein the area results from integrating the waveform of the amount of light transmitted to the liquid crystal with a light emitting period of the light emitting diode when the driving voltage is applied to the liquid crystal, and then varies the area to perform the gradation display.

The method for employing the integration of the amount of transmission light as mentioned above sets the voltage applying time in consideration of the area obtained from integrating the amount of transmission light with the light emitting period of the LED, so that a fine gradation display suitable for the gradation display is possible, and the waveform of the amount of light transmitting the liquid crystal is drastically increased or decreased improving the response time of the liquid crystal.

FIGS. 2A and 2B show waveforms explaining a method of driving a digital driving type liquid crystal display of the prior art. In particular, FIGS. 2A and 2B show the waveform of the driving voltage based on the driving data having a predetermined bit and the waveform of the amount of light transmitted to the liquid crystal based thereon.

Referring to FIGS. 2A and 2B, driving data corresponding to each gradation are supplied as a digital signal having predetermined bits, for example, seven bits, and a driving voltage based on the driving data having the seven bits is applied to the liquid crystal. The amount of light transmitted to the liquid crystal is determined based on the applied driving voltage to thereby perform the gradation display.

However, in the conventional digital type driving method as mentioned above, the number of bits of the driving data should be increased so as to implement a full color gradation display with a fast response time. In the meantime, in the liquid crystal display employing the field sequential driving method, since R, G and B light emitting diodes are sequentially driven in a time-division manner as compared to the conventional liquid crystal display, a higher driving frequency is employed as compared to the conventional liquid crystal display. As such, when the number of bits of the driving data is increased to implement the full color gradation display with the fast response time, the driving frequency increases more and more.

As such, when the driving frequency is increased, distortion from a gate driving voltage and a common power source voltage (Vcom) occurs, causing degradation in image quality. Furthermore, the liquid crystal is driven by the high driving frequency at a fast speed, causing an increase in power consumption. In addition, in the conventional digital driving method, the effective value response of the current gradation to be displayed is affected by the gradation just previously displayed, which causes difficulty in performing a fine gradation display. In particular, when the intermediate gradation is to be displayed, the gradation that has been just previously displayed significantly affects the current gradation to be displayed.

To cope with the above-mentioned problem that the effective value response is affected by the just previously displayed gradation in the digital type driving method, U.S. Pat. No. 6,567,063 discloses a method for digitally displaying the gradation using reset pulses.

FIGS. 3A through 3F show waveforms explaining a method of driving a digital type LCD using reset pulses in accordance with the prior art. Referring to FIG. 3, a plurality of periods T31 to T36 are employed to drive each of the R, G and B light emitting diodes for R. G. B backlights to thereby perform the gradation display.

A predetermined voltage VLC based on the R gradation data is applied to the liquid crystal in the T31 period, and the light transmitted by the liquid crystal is based on the applied voltage, so that the R light is displayed in the period where the R light emitting diode emits light. A predetermined voltage VLC based on the G gradation data is applied to the liquid crystal in the T32 period, and the light transmitted by the liquid crystal is based on the applied voltage, so that the G light is displayed in the period where the G light emitting diode emits light. In the mean time, a predetermined voltage VLC based on the B gradation data is applied to the liquid crystal in the T33 period, and the light transmitted by the liquid crystal is based on the applied voltage, so that the B light is displayed in the period where the B light emitting diode emits light. Thus, a color having a predetermined gradation is displayed.

In the above-mentioned digital driving method, a predetermined voltage is applied, which is different from the absolute value of the gradation data and has no relation with the gradation data during a predetermined time (i.e., each of t31 to t36) at the point where each of the periods T31 to T36 end. Thus, after R, G and B colors having a predetermined gradation are displayed at each of the period T31 to T36, a voltage that has no relation with the gradation data is supplied at the end point of each period so that no light is transmitted. Thus, when the liquid crystal is driven by the applied voltage based on the gradation data at each of the periods T31 to T36, the current period is not affected by transmission and liquid crystal state of the previous period so that the response time of the liquid crystal may be improved. In this case, the signal applied at the end point of each period T31 to T36 is referred to as a reset pulse, which improves the response time of the liquid crystal.

Thus, the digital gradation displaying method using the above-mentioned reset pulse has the advantage that the response time of the liquid crystal is improved to implement moving pictures. However, this method should allocate a predetermined portion of driving data bits to the reset pulses, which causes a significant increase in the bit number of the driving data as compared to the conventional digital driving method. When the bit number of the driving data increases, the above-mentioned driving frequency also increases increasing power consumption, and distortion from the gate voltage and the common voltage also causes degradation in the image quality.

Thus, when the liquid crystal display is driven in a digital manner, a gate pulse width with not less than a threshold value should be maintained, which limits fast driving and increases the frame frequency for preventing flicker. As such, a reverse driving method cannot be applied to improve the image quality, which causes cross talk, flicker, or the like.

SUMMARY OF THE INVENTION

It is, therefore, an aspect of the present invention to provide a method of driving a liquid crystal display capable of displaying a full color gradation without increasing the bit number of the driving data.

It is another aspect of the present invention to provide a method of driving a liquid crystal display capable of reducing power consumption by means of low frequency driving.

It is yet another aspect of the present invention to provide a method of driving a liquid crystal display capable of preventing a response time delay between intermediate gradations.

To achieve the above and/or other aspects, one aspect of the present invention provides a method of driving a liquid crystal display having a liquid crystal interposed between an upper substrate and a lower substrate, the method comprising driving the liquid crystal in accordance with driving data of predetermined bits corresponding to different gradations to display a full color gradation, wherein a pulse corresponding to each bit of the driving data has a predetermined pulse width and a predetermined voltage level, and at least one of the pulse width and the voltage level of the pulse corresponding to each bit of the driving data is varied to drive the liquid crystal so that the full color gradation is displayed.

According to an aspect of the invention, the pulse corresponding to at least one bit of the driving data of predetermined bits may be made to have at least one of the pulse width and voltage level varied in accordance with the gradation.

According to an aspect of the invention, the pulse corresponding to each bit of the driving data in accordance with the gradation may be made to have its voltage level constant and its width varied, to have its pulse width constant and its voltage level varied, or to have its pulse width and voltage level varied at the same time.

According to an aspect of the invention, some of the pulses corresponding to each bit of the driving data may be made to have their widths constant and their voltage levels varied, and the rest of the pulses may be made to have their voltage levels constant and their widths varied.

According to an aspect of the invention, some of the pulses corresponding to each bit of the driving data may be made to have one of their widths and voltage levels varied, and the rest of the pulses may be made to have their voltage levels and widths varied together.

According to an aspect of the invention, some of the predetermined bits of the driving data may be allocated for reset pulses for resetting the liquid crystal, and the rest of the predetermined bits may be allocated for gradation data for displaying the gradation.

In addition, an aspect of the present invention provides a method of driving a liquid crystal display having a liquid crystal interposed between an upper substrate and a lower substrate, the method comprising driving the liquid crystal in accordance with driving data of predetermined bits corresponding to each gradation to display the gradation, wherein a pulse corresponding to each bit of the driving data has a predetermined width and a predetermined voltage level, and at least one of the pulse width and the voltage level of a pulse corresponding to each bit of effective data bits of the driving data of predetermined bits is varied to drive the liquid crystal so that the gradation is displayed.

According to another aspect of the present invention, a method of driving a liquid crystal display having a liquid crystal interposed between an upper substrate and a lower substrate comprises varying driving data of predetermined bits corresponding to gradation to analog type driving voltage waveforms corresponding to each bit of the driving data to drive the liquid crystal so that the gradation is displayed.

According to an aspect of the invention, the driving voltage waveforms may be made to have at least one of their voltage levels and pulse widths varied to display the gradation.

In addition, an aspect of the present invention provides a method of driving a liquid crystal display, in which the liquid crystal display comprises upper and lower substrates, upper and lower electrodes arranged in the upper and lower substrates respectively, and a liquid crystal interposed between the upper and lower electrodes, the method comprising: applying a data signal to at least one of the upper and lower electrodes, the data signal being formed of pulses having at least three voltage levels different from one another; and performing gradation display through a combination of the pulse signals forming the data signal.

According to an aspect of the invention, the voltage levels of the pulse signals forming the data signal may be one of a minimum voltage level and a maximum voltage level, or any one that ranges from the minimum voltage level to the maximum one.

According to an aspect of the invention, the pulses forming the data signal may have at least three voltage levels different from one another in their absolute values, or have at least three voltage levels different from one another that have the same polarities, or have at least three voltage levels and polarities different from one another.

According to an aspect of the invention, the at least one of the pulses forming the data signal may have its pulse width varied to perform the gradation.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1A:
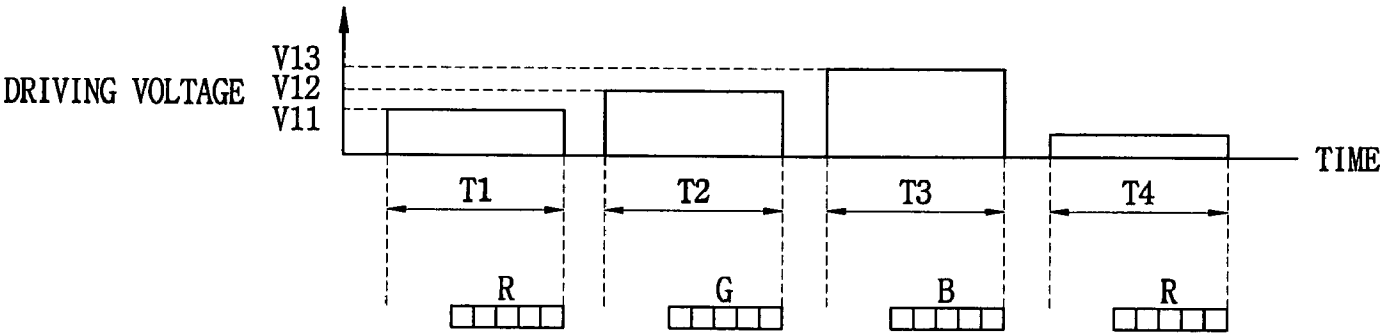
FIG. 1A (PRIOR ART)
FIGS. 1A and 1B show waveforms explaining a method of driving an analog type LCD.
Figure 1B:
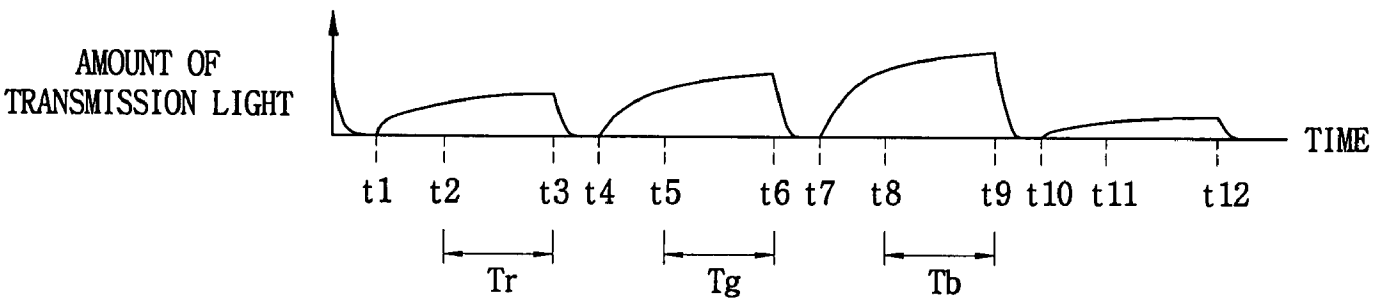
FIG. 1B (PRIOR ART)
Figure 2A:
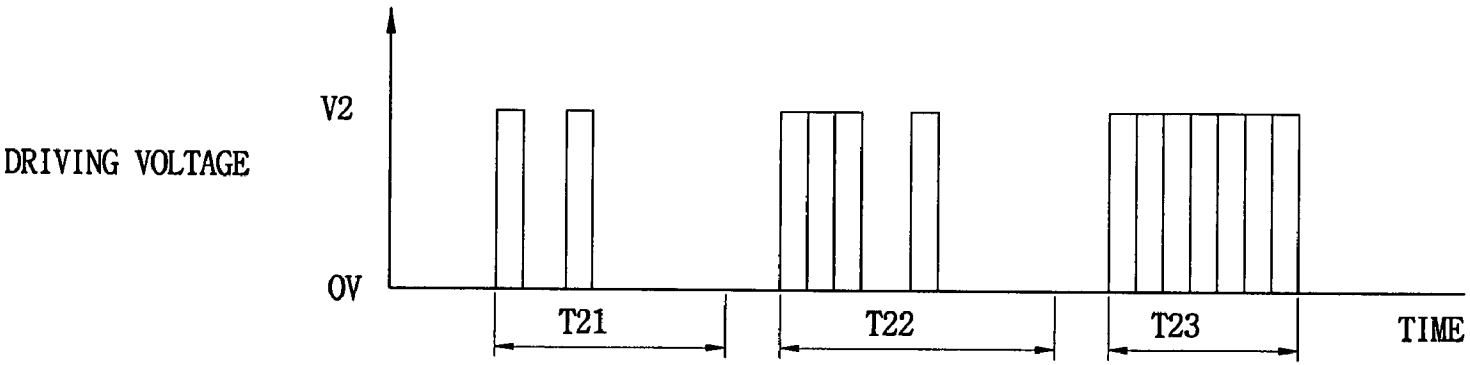
FIG. 2A (PRIOR ART)
FIGS. 2A and 2B show waveforms explaining a method of driving a digital type LCD.
Figure 2B:
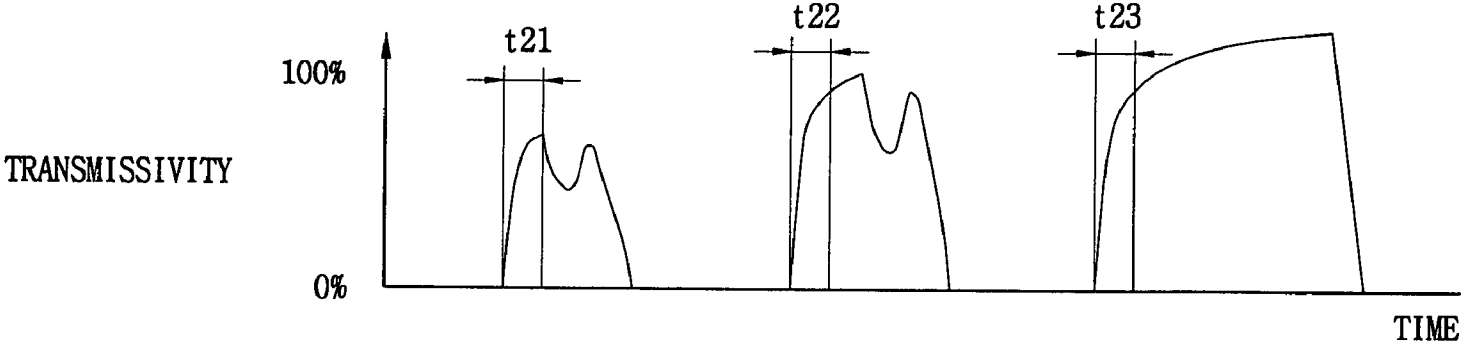
FIG. 2B (PRIOR ART)
Figure 3A:
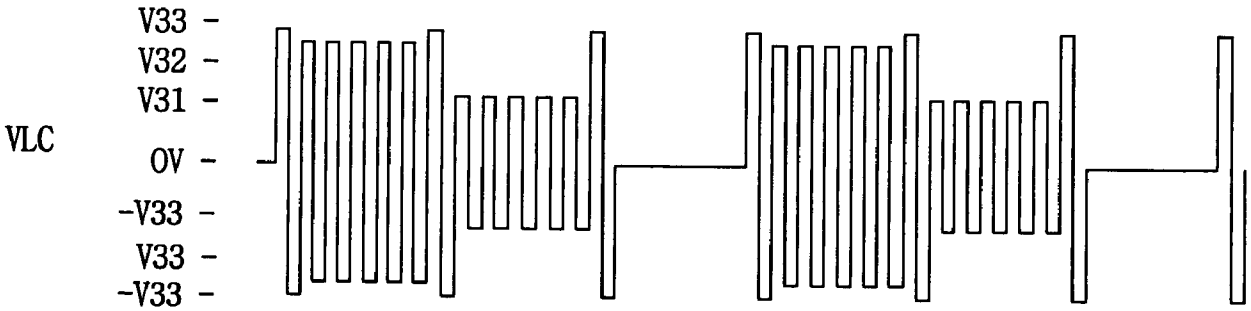
FIG. 3A (PRIOR ART)
FIGS. 3A through 3F show waveforms explaining a method of driving a digital type LCD using reset pulses.
Figure 3B:
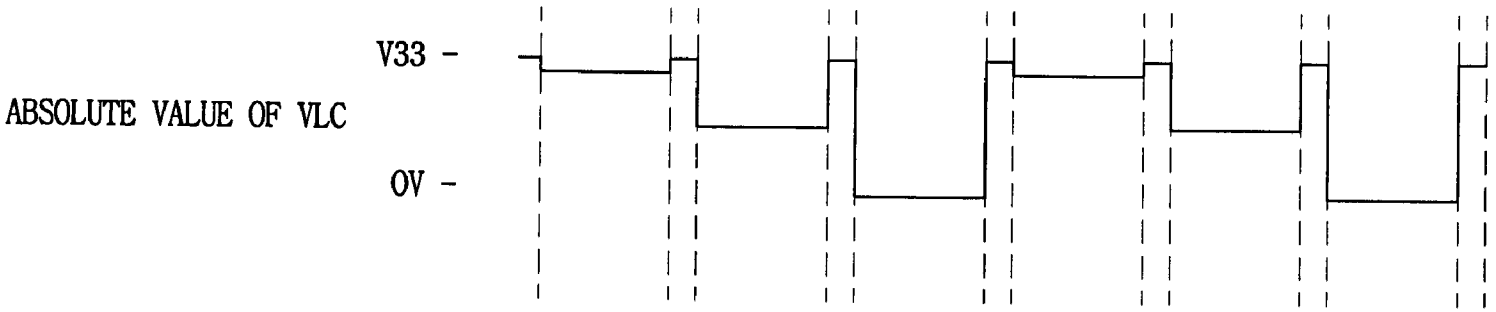
FIG. 3B (PRIOR ART)
Figure 3C:
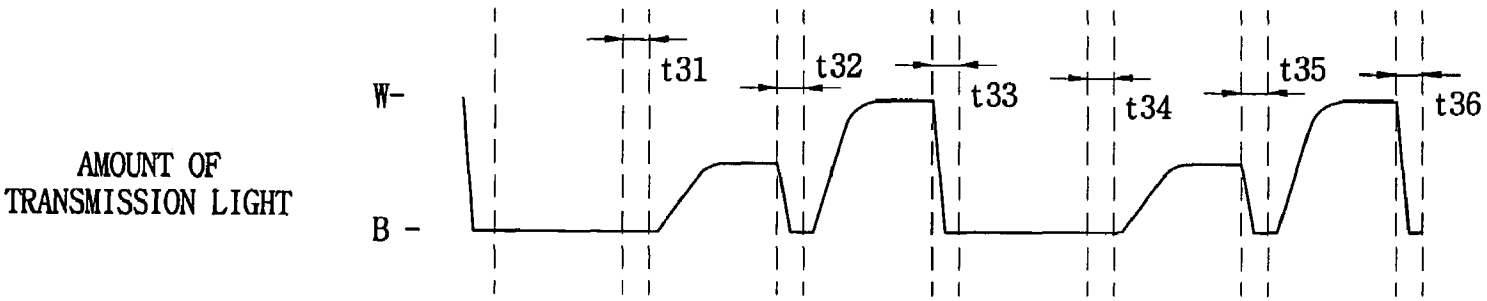
FIG. 3C (PRIOR ART)
Figure 3D:
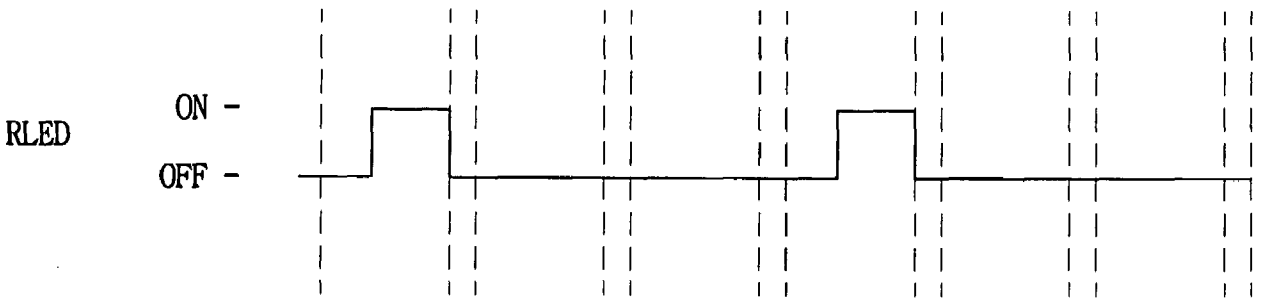
FIG. 3D (PRIOR ART)
Figure 3E:
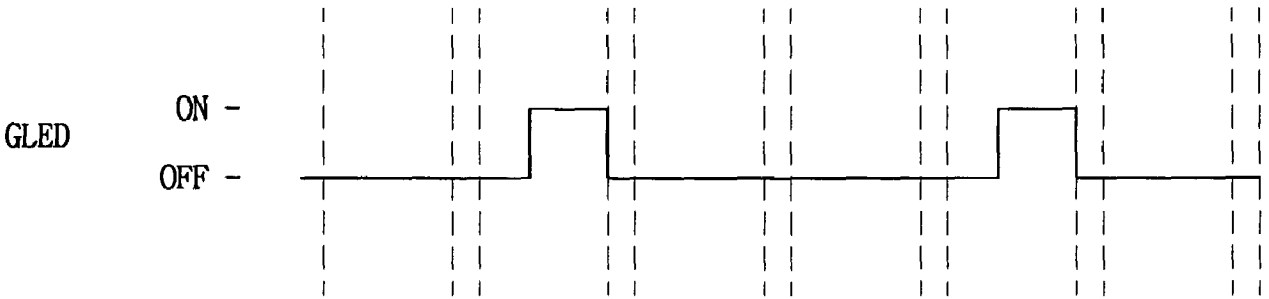
FIG. 3E (PRIOR ART)
Figure 3F:
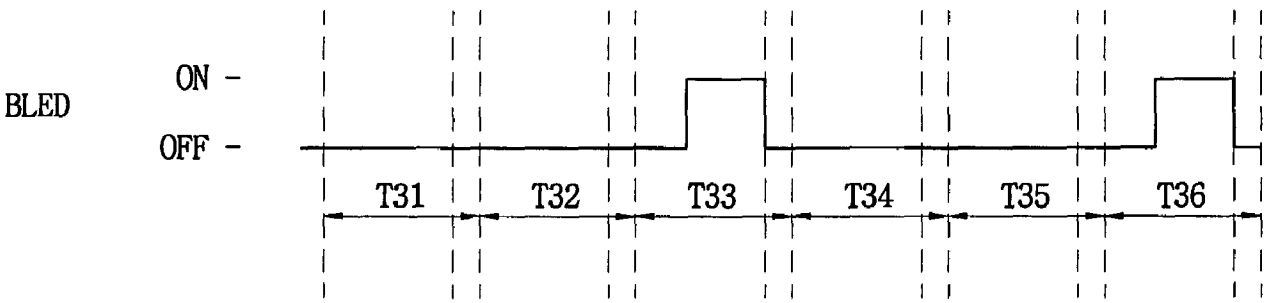
FIG. 3F (PRIOR ART)

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 4A:
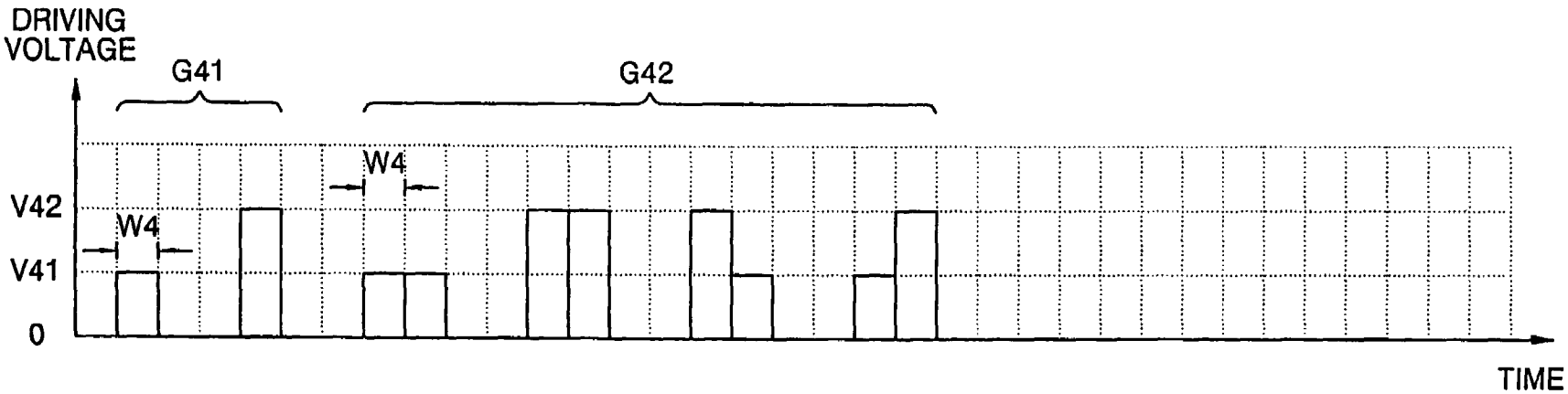
FIG. 4A shows waveforms explaining a method of driving a digital type LCD using two voltage levels different from each other in accordance with an embodiment of the present invention.

FIG. 4A shows waveforms of driving voltages explaining a method of driving a liquid crystal display in accordance with an embodiment of the present invention. The shown method of driving the liquid crystal display implements multi gradations not less than four gradations using two bit driving data, wherein a level of the driving voltage corresponding to each bit of the driving data is varied to implement the multi gradations. Referring to FIG. 4A, when the two bit driving data is "01" or "10", a level of the driving voltage corresponding to an effective data bit between the two bits of the driving data (namely, "1" bit) is varied to a first level V41 or V42, so that the two gradations shown as the group G41 in the FIG. 4A can be displayed.

Alternatively, when the two bit driving data of "11" is applied, driving voltages of V41 and V42 different from each other may be applied to each of the "11" bits to drive the liquid crystal. In other words, only one level of the driving voltage corresponding to one bit between the two bits of the driving data may be varied or all levels of the driving voltages corresponding to the two bits may be varied, so that the four gradations may be displayed as the group G42 shown in the FIG. 4A.

Therefore, the shown aspect of the present invention can implement multi gradations not less than four gradations using two bit driving data, whereas the conventional digital method for displaying the gradation can display only four gradations when the two bit driving data is used. In other words, the present invention can display the multi gradations using digital driving data of the two bits and two analog voltage levels different from each other.

Specifically, in order to implement the multi gradations using two bit driving data having a driving voltage waveform of pulse type per each of the bits, the pulse width of each bit is kept constant and the voltage level of each bit is varied between two levels different from each other. Thus, the driving voltage applied to the liquid crystal based on the voltage level of each of the bits is changed even when the same two bit driving data is used. Therefore, the driving voltage applied to the liquid crystal is changed, which in turn changes the amount of light transmitted to the liquid crystal to thereby implement the gradation display.

FIG. 4A shows 2.5V (i.e., V41) and 5V (i.e. V42) as analog voltage levels of each bit of the two bit driving data. However, this example is described to help understand the method for driving the liquid crystal with a mixed driving method of digital and analog driving methods, so that two voltage levels can be selected among driving voltages suitable for the liquid crystal of the liquid crystal display. For example, analog voltage levels of each bit of the driving data may have the positive polarities and have voltage levels different from one another at the same time, or may have the negative polarities and have voltage levels different from one another at the same time. Alternatively, analog voltage levels of each bit of the driving data may have the voltage levels that are different from one another in their absolute values among the voltage levels having positive polarities and the voltage levels having negative polarities. And the analog voltage level may be any one selected between the highest voltage level and the lowest voltage level of data signals for driving the liquid crystal display.

Figure 4B:
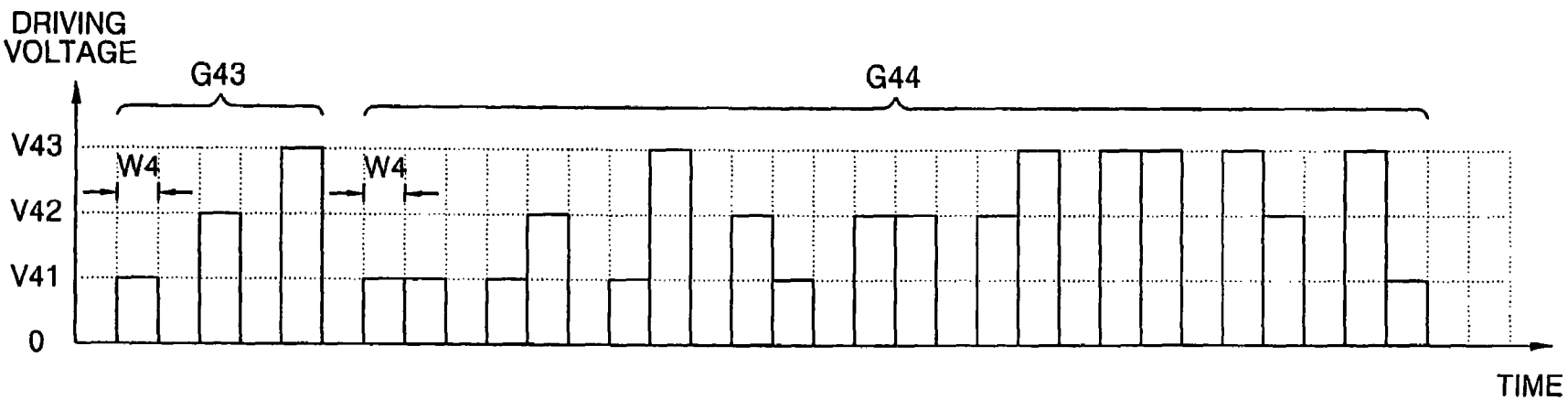
FIG. 4B shows waveforms explaining a method of driving a digital type LCD using three voltage levels different from each other in accordance with an embodiment of the present invention.

FIG. 4B shows waveforms of driving voltages explaining a method of driving a liquid crystal display in accordance with an embodiment of the present invention. Referring to FIG. 4B, the method of driving the liquid crystal display varies the voltage level of each bit of two bit driving data to three analog voltage levels different from one another to thereby implement multi gradations. Typically, when the gradation display is performed using the two bit driving data, only four gradations are obtainable, whereas the shown embodiment can implement the multi gradations of not less than four.

In other words, driving voltage waveforms having three voltage levels different from one another shown as the group G43 may be applied to the liquid crystal when the two bit driving data of "10" or "01" is used, and driving voltage waveforms having nine driving voltage waveforms different from one another shown as the group G44 may be applied when the gradation data of "11" is used. Therefore, the amount of light transmitted to the liquid crystal is varied by the applied driving voltage waveform as shown in the G43 and G44, which implements the multi gradation display. To sum up, when the two bit driving data is used such that each bit has three voltage levels different from one another, multi gradations not less than four can be displayed.

As described in the shown embodiments of FIGS. 4A and 4B, the driving voltage is provided such that each bit of the driving data has two voltage levels different from each other not less than two, so that the driving data has only two bits without any increase in the number of bits, and multi gradation display can be implemented not less than the number of the gradation in a typical method for displaying digital gradation. Each bit of the driving data has two or three voltage levels different from one another. However, a plurality of voltage levels different from one another may be set in accordance with the liquid crystal display to be driven to thereby implement the multi gradation without increasing the number of bits of the driving data. In addition, all effective data bits of the driving data have voltage levels different from one another. However, a voltage level of at least one bit among the plurality of effective data bits may be varied to thereby implement the multi gradation without increasing the number of bits of the driving data as described in the above driving method.

Figure 5A:
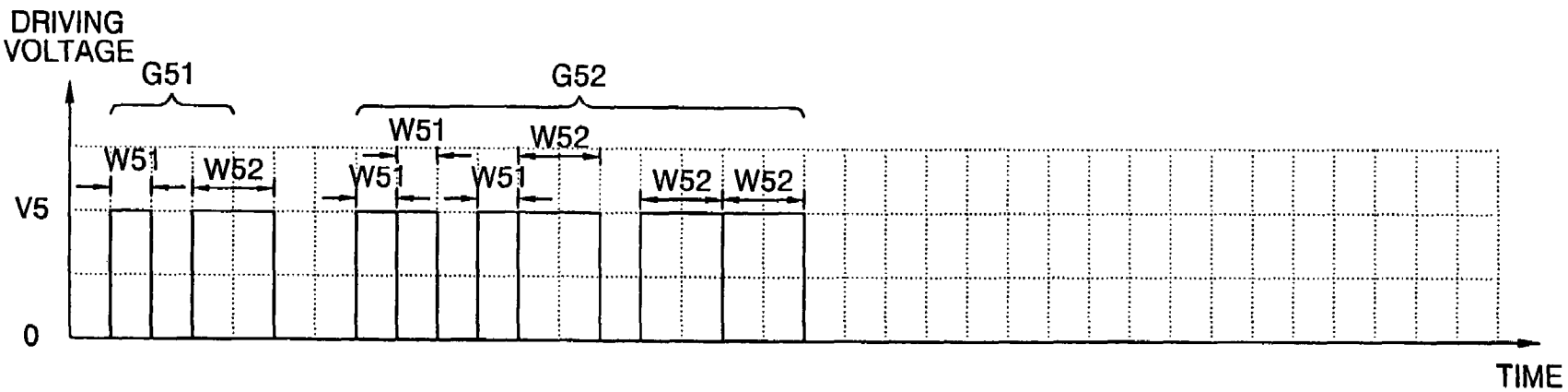
FIG. 5A shows waveforms explaining a method of driving a digital type LCD using two pulse widths different from each other in accordance with an embodiment of the present invention.

FIG. 5A shows waveforms of driving voltages explaining a method for driving a liquid crystal display in accordance with an embodiment of the present invention. The shown driving method displays the multi gradation employing an analog and digital driving mixed technique, wherein a pulse width of each bit of the driving data is varied to implement the multi gradation display.

Specifically, as shown in FIG. 5A, the method driving the liquid crystal display implements multi gradations of not less than four gradations using two bit driving data, wherein a pulse width of the driving voltage corresponding to each bit of the driving data is varied to implement the multi gradations. Referring to FIG. 5A, when the two bit driving data is "01" or "10", the pulse width of the driving voltage corresponding to an effective data bit between the two bits of the driving (namely, "1" bit) is varied, two gradations shown as the group G51 in FIG. 5A can be displayed. Alternatively, when the two bit driving data of "11" is applied, driving voltages of pulse widths W51 and W52 different from each other may be applied per each bit of the "11" to drive the liquid crystal. As such, only pulse width of the driving voltage corresponding to one bit between the two bits of the driving data may be varied or all pulse widths of the driving voltages corresponding to the two bits may be varied, so that the three gradations may be displayed as the group G52 shown in FIG. 5A.

In other words, when the two bit driving data "10" or "01" are applied, the "10" or "01" driving data having a predetermined pulse width W51, or the "10" or "01" driving data having a pulse width W52 larger than the pulse width W51 may be provided, so that the two gradations may be displayed as the group G51 shown in FIG. 5A. Furthermore, even when the two bit driving data of "11" is applied, a driving voltage having a pulse width different from each other is applied to each bit, so that the three gradations may be displayed as the group G52 shown in FIG. 5A. Therefore, multi gradations not less than four can be implemented using two bit driving data in the present invention. In other words, two bit driving data and two analog voltages having pulse widths different from each other are used to thereby implement the multi gradations not less than four.

To detail this, a voltage level of each bit of the driving data is kept to be the same and a pulse width of each bit is varied to have two pulse widths different from each other so as to implement the multi gradations using two bit driving data having a pulse type of driving voltage waveform per each bit. Thus, the time during which the driving voltage is applied to the liquid crystal is varied in accordance with the pulse width of each bit even in the case of the same two bit digital driving data. Therefore, the amount of light transmitted to the liquid crystal is varied thereby implementing the multi gradations.

Figure 5B:
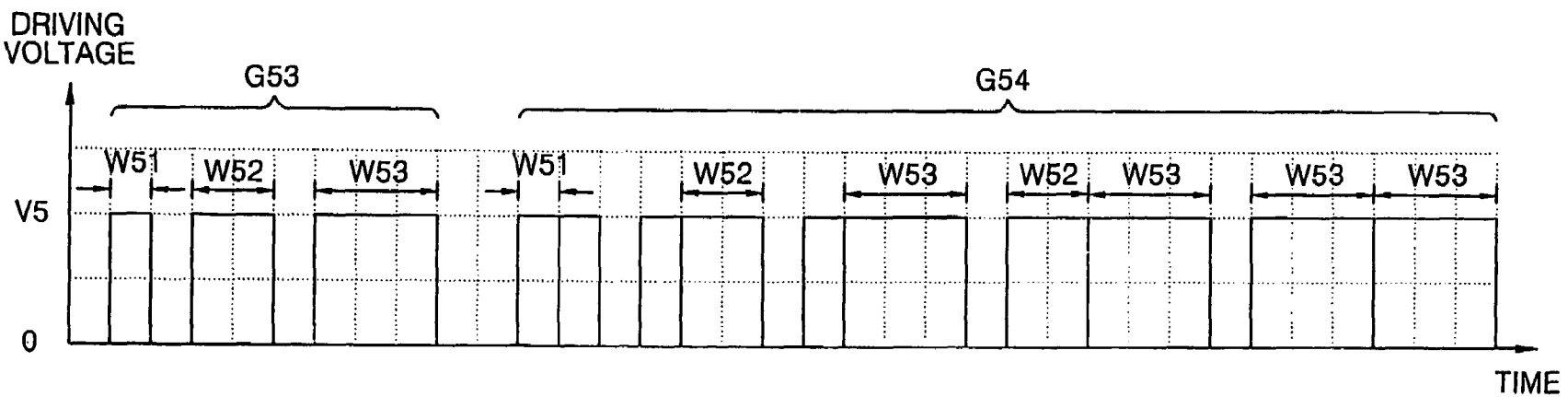
FIG. 5B shows waveforms explaining a method of driving a digital type LCD using three pulse widths different from each other in accordance with an embodiment of the present invention.

FIG. 5B shows waveforms of driving voltages explaining a method for driving a liquid crystal display in accordance with an embodiment of the present invention. Referring to FIG. 5B, the method for driving the liquid crystal display varies the pulse width of the driving voltage of each bit of two bit driving data to three pulse widths different from one another to thereby implement multi gradations. Typically, when the gradation display is performed using the two bit driving data, only four gradations are obtainable, whereas the shown embodiment can implement the multi gradations of not less than four.

In other words, driving voltage waveforms having three pulse widths different from one another shown as the group G53 may be applied to the liquid crystal when the two bit driving data of "10" or "01" is used, and driving voltage waveforms having five driving voltage waveforms different from one another shown as the group G54 may be applied when the gradation data of "11" is used. Therefore, the amount of light transmitted to the liquid crystal is varied by the applied driving voltage waveforms as shown in the G53 and G54, which implements the multi gradation display. To sum up, when the two bit driving data is used such that each bit has three pulse widths different from one another, multi gradations of not less than four can be displayed.

As described in the embodiment shown in FIGS. 5A and 5B, the driving voltage is provided such that each bit of the driving data has not less than two pulse widths different from each other. Thus, the driving data has only two bits without any increase in the number of bits, and multi gradation display can be implemented with not less than the number of the gradations in a typical method for displaying digital gradation.

In the shown embodiments of the present invention in FIGS. 5A and 5B, each bit of the driving data has two or three pulse widths different from one another. However, a plurality of pulse widths different from one another may be set in accordance with the liquid crystal display to be driven to thereby implement the multi gradation without increasing the number of bits of the driving data. In addition, all data bits of the driving data have pulse widths different from one another. However, the pulse width of at least one bit among the plurality of data bits may be varied to thereby implement the multi gradation without increasing the number of bits of the driving data as described in the above driving method.

Figure 6A:
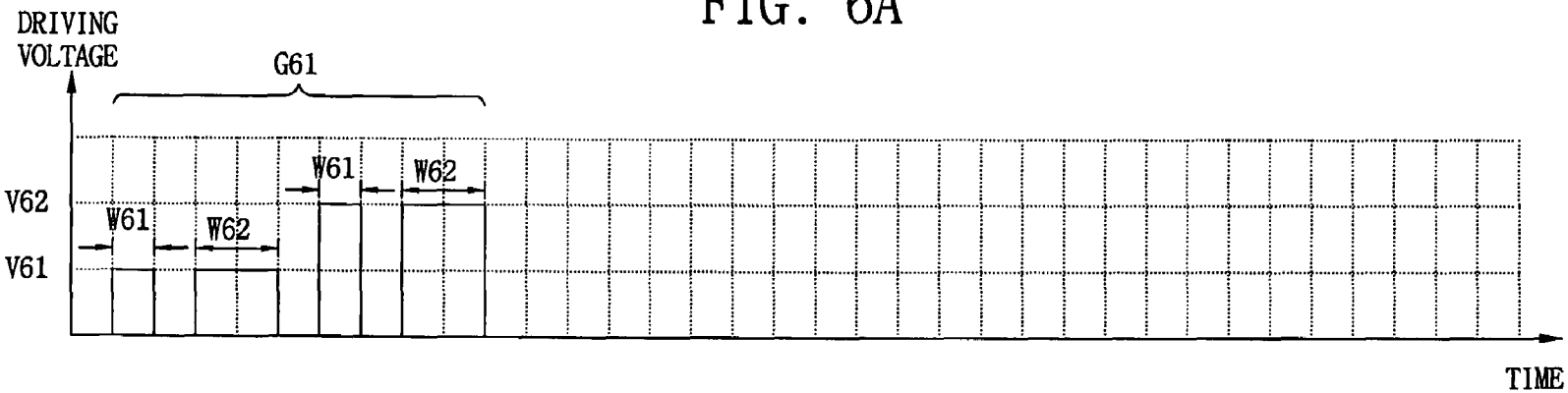
FIGS. 6A through 6C show waveforms explaining a method of driving a digital type LCD using two voltage levels different from each other and two different pulse widths from each other in accordance with a third embodiment of the present invention.
Figure 6B:
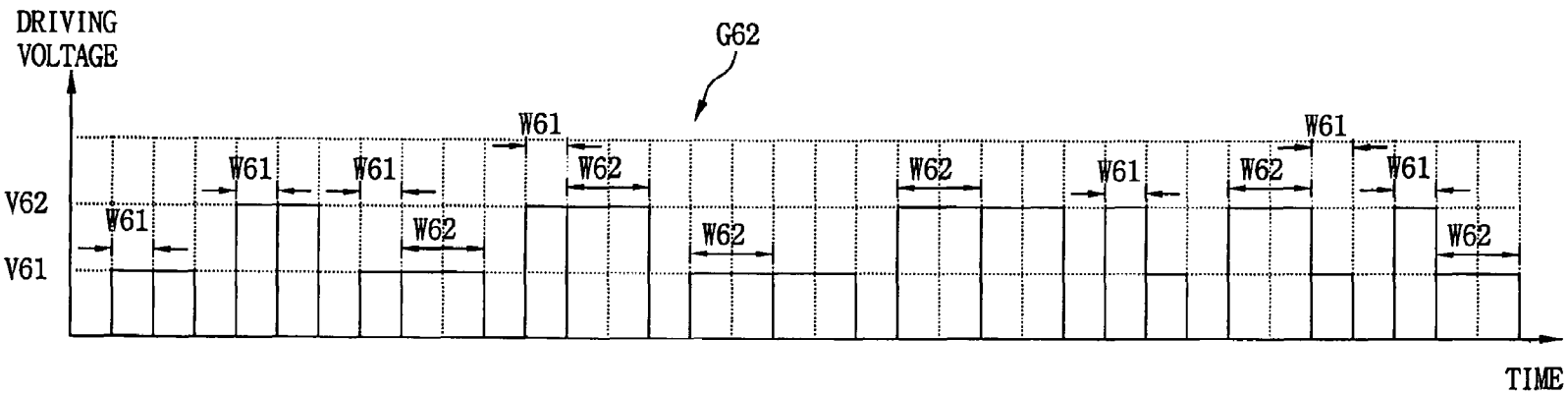
Figure 6C:
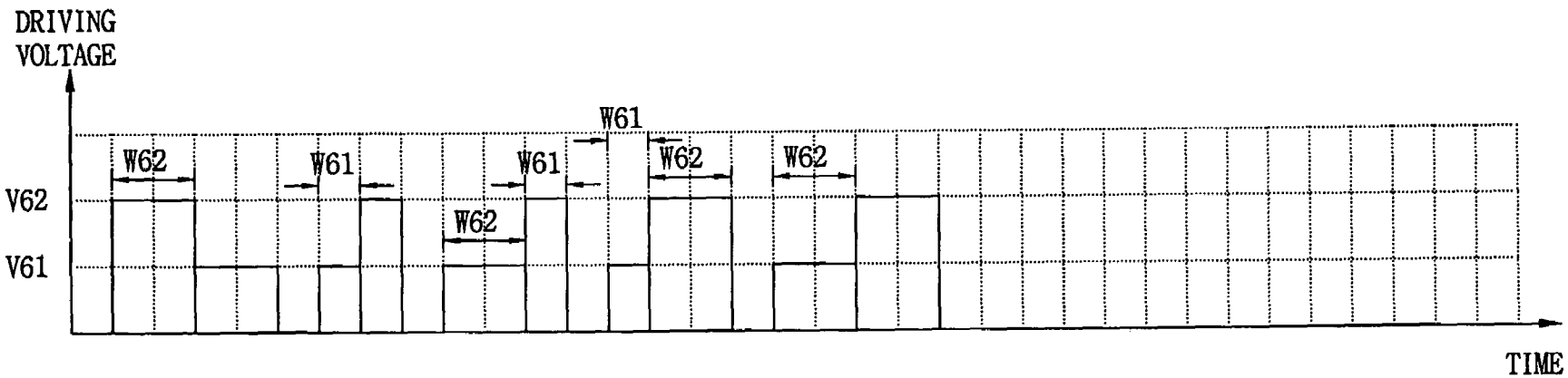

FIGS. 6A through 6C show driving voltage waveforms explaining a gradation display method of a liquid crystal display in accordance with an embodiment of the present invention. The shown gradation display method displays multi gradations using a mixed analog and digital driving technique, wherein a different pulse width and a different voltage level are applied to each bit of the driving data to display the multi gradations.

Referring to FIGS. 6A through 6C, driving voltages for displaying the multi gradations are applied to correspond to two bit driving data. In this case, the driving voltage applied to the liquid crystal allows each bit of the driving data to have two voltage levels different from each other and two pulse widths different from each other. When the driving data having the voltage level and the pulse width different from each other is applied, the amount of light transmitted to the liquid crystal is varied in accordance with each of the driving data, which causes the gradation to be displayed in accordance with the varied amount resulted from each of the driving data.

Specifically, when the two bit driving data of "10" or "01" are applied, the "10" or "01" driving data having a pulse width selected from predetermined pulse widths W61 and W62 and a voltage level selected from predetermined voltage levels V61 and V62 may be provided, so that the four gradations may be displayed as the group G61 shown in FIG. 6A. In addition, even when the two bit driving data of "11" are applied, each bit is applied with a driving voltage having a pulse width different from one another and a voltage level different from one another, so that the fourteen gradations may be displayed as the group G62 shown in FIG. 6B.

Therefore, multi gradations not less than four may be implemented using two bit driving data in the third embodiment of the present invention. In other words, two bit driving data and an analog voltage having a pulse width different from one another and a voltage level different from one another are used to thereby display the eighteen gradations as shown in FIGS. 6A through 6C.

As mentioned above, each bit of the gradation data has at least two pulse widths different from one another and at least two voltage levels different from one another, so that the multi gradation display can be implemented by not less than the number of the gradations in a typical method for displaying digital gradation without any increase of the number of the driving data bits. In addition, each bit of the driving data has voltage levels different from one another and pulse widths different from one another. However, the voltage level and the pulse width of at least one bit among a plurality of bits of the driving data may be varied to thereby implement the multi gradations without increasing the number of bits of the driving data as mentioned above.

In this case, some of the driving bits may have pulse widths varied, and others may have voltage levels varied, so that the multi gradations may be implemented. In addition, driving data having two pulse widths and two voltage levels are described in the third embodiment of the present invention, however, at least two pulse widths or at least two voltage levels may be properly set in accordance with the number of gradations to be displayed.

Figure 7A:
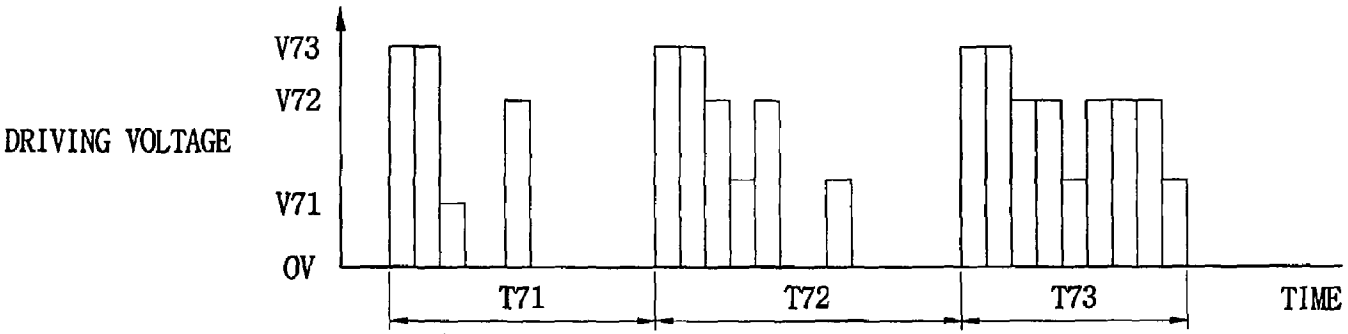
FIGS. 7A and 7B show waveforms explaining a method f driving a digital type LCD using reset pulses in accordance with an embodiment of the present invention.
Figure 7B:
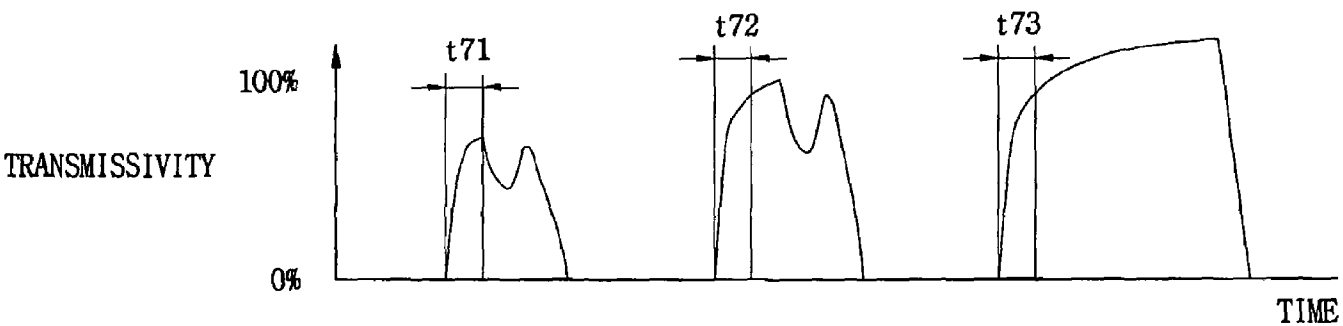

FIGS. 7A and 7B show waveforms explaining a method for driving a liquid crystal display in accordance with an embodiment of the present invention. FIGS. 7A and 7B particularly show a driving voltage applied to a liquid crystal corresponding to nine bit driving data and waveforms with respect to the amount of light transmitted to the liquid crystal.

Referring to FIGS. 7A and 7B, the driving voltage with respect to the nine bit driving data is applied to the liquid crystal, wherein seven bit gradation data "1010000" and two bit reset data "11" are applied in the period T71, seven bit gradation data "1110100" and two bit reset data "11" are applied in the period T72, and seven bit gradation data of "1111100" and two bit reset data "11" are applied in the period T73.

As shown, a reset pulse, which returns the liquid crystal to its original state, is applied at the start point of each period T71 to T73, and the gradation data is then applied. Therefore, the response time of the liquid crystal may be improved. In this case, two to three bits among the driving data are allocated for the reset pulse. The predetermined bits of driving data are shown to have voltage levels different from one another in the fourth embodiment, however, the reset pulse may also be allocated even when the pulse widths are varied as shown in FIGS. 5A, 5B, and 6A through 6C to thereby improve the response time of the liquid crystal.

As mentioned above, the digital pulse width and the voltage of the driving data are varied in an analog manner in the embodiments, and the gradations are displayed in the analog and digital mixed gradation manner, so that the number of bits of the driving data are not increased, the full color gradation is facilitated, and the power consumption is reduced. In addition, the multi gradations may be displayed without increasing the driving frequency, which can be applied to the liquid crystal display of a reverse driving type, reducing flicker and cross-talk problems.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A method of driving a liquid crystal display having a liquid crystal interposed between an upper substrate and a lower substrate, the method comprising:

driving the liquid crystal in accordance with driving data of predetermined bits corresponding to multi gradations, wherein a pulse corresponding to each bit of the driving data has at least one corresponding predetermined pulse width and a predetermined voltage level, and the voltage levels of the pulse corresponding to each bit of the driving data is varied to drive the liquid crystal so that a gradation is displayed, wherein the number of all pulses generated by varying the voltage levels outnumbers the number of pulses generated by predetermined bits of the driving data.

2. The method as claimed in claim 1, wherein the pulse corresponding to at least one bit of the predetermined bits of the driving data is made to have the pulse widths varied in accordance with the gradation.

3. The method as claimed in claim 2, wherein the pulse corresponding to each bit of the driving data in accordance with the gradation is made to have the pulse width constant and the voltage level varied.

4. The method as claimed in claim 2, wherein the pulse corresponding to each bit of the driving data in accordance with the gradation is made to have the pulse width and the voltage level varied at the same time.

5. The method as claimed in claim 2, wherein some of pulses corresponding to each bit of the driving data are made to have one of the widths and voltage levels varied, and others of the pulses are made to have the voltage levels and widths varied together.

6. The method as claimed in claim 1, wherein some of the predetermined bits of the driving data are allocated for reset pulses for resetting the liquid crystal, and the remaining of the predetermined bits are allocated for gradation data for displaying the gradation.

7. A method of driving a liquid crystal display having a liquid crystal interposed between an upper substrate and a lower substrate, the method comprising:

driving the liquid crystal in accordance with driving data of predetermined bits corresponding to multi gradations to display a gradation, wherein a pulse corresponding to each bit of the driving data has at least one corresponding predetermined pulse width and a predetermined voltage level, and the voltage levels of the pulse corresponding to each bit of effective data bits of the driving data of predetermined bits is varied to drive the liquid crystal so that the gradation is displayed, wherein the number of all pulses generated by varying the voltage levels outnumbers the number of pulses generated by predetermined bits of the driving data.

8. The method as claimed in claim 7, wherein the pulse corresponding to at least one bit among the effective data bits of the driving data is made to have at least one of the width and voltage level varied in accordance with the gradation.

9. The method as claimed in claim 8, wherein the pulse corresponding to the effective data bit of the driving data in accordance with the gradation is made to have the pulse width constant and the voltage level varied.

10. The method as claimed in claim 8, wherein the pulse corresponding to the effective data bit of the driving data in accordance with the gradation is made to have the pulse width and voltage level varied at the same time.

11. The method as claimed in claim 8, wherein some pulses corresponding to the effective data bits of the driving data are made to have one of the widths and voltage levels varied, and the rest of the pulses are made to have the voltage levels and widths varied together.

12. The method as claimed in claim 7, wherein some of the predetermined bits of the driving data are allocated for reset pulses for resetting the liquid crystal, and the rest of the predetermined bits are allocated for gradation data for displaying the gradation.

13. A method of driving a liquid crystal display having a liquid crystal interposed between an upper substrate and a lower substrate, the method comprising:

varying voltage levels of driving data of predetermined bits corresponding to gradation to analog values of driving voltage waveforms corresponding to each bit of the driving data to drive the liquid crystal so that the gradation is displayed, wherein the number of all pulses generated by varying the voltage levels outnumbers the number of pulses generated by predetermined bits of the driving data.

14. A method of driving a liquid crystal display, in which the liquid crystal display comprises upper and lower substrates, upper and lower electrodes arranged in the upper and lower substrates respectively, and a liquid crystal interposed between the upper and lower electrodes, the method comprising:

applying a data signal to at least one of the upper and lower electrodes, the data signal being formed of pulses having at least three varying voltage levels different from one another for each bit of driving data; and performing gradation display through a combination of the pulse signals forming the data signal, wherein the number of all possible pulse signals forming the data signal outnumbers the number of all possible pulse signals from combinations of the data signal.

15. The method as claimed in claim 14, wherein the voltage levels of the pulse signals forming the data signal are one of a minimum voltage level and a maximum voltage level, and any one that ranges from the minimum voltage level to the maximum voltage level.

16. The method as claimed in claim 14, wherein the pulses forming the data signal have at least three voltage levels different from one another in absolute values.

17. The method as claimed in claim 14, wherein the pulses forming the data signal have at least three voltage levels different from one another of same polarities.

18. The method as claimed in claim 14, wherein the pulses forming the data signal have at least three voltage levels and polarities different from one another.

19. The method as claimed in claim 14, wherein at least one of the pulses forming the data signal has a pulse width varied to perform the gradation.

20. The method of claim 6, wherein the gradation data is applied after the reset pulses.

21. The method of claim 12, wherein the gradation data is applied after the reset pulses.

* * * * *